United States Patent [19]

Trapasso et al.

[11] Patent Number: 5,011,292

[45] Date of Patent: Apr. 30, 1991

[54] LIQUID PUMPING, MIXING AND DISPENSING APPARATUS

[76] Inventors: Timothy Trapasso, Phinney Rd., Gramby, N.Y. 13609; John J. Howland, R.D. 3, Lockwood Rd., Auburn, N.Y. 13021

[21] Appl. No.: 561,177

[22] Filed: Aug. 1, 1990

[51] Int. Cl.[5] ..... B01F 15/04

[52] U.S. Cl. ..... 366/161; 366/337

[58] Field of Search ..... 366/131, 136, 137, 150, 366/152, 159, 160, 161, 162, 336, 337, 338, 339, 340; 222/129.1, 129.3

[56] References Cited

U.S. PATENT DOCUMENTS

| | | | |
|---|---|---|---|
| 4,118,799 | 10/1978 | Krueger | 366/162 |
| 4,798,474 | 1/1989 | Daily | 366/162 |
| 4,832,499 | 5/1989 | Fiorentini | 366/160 |

*Primary Examiner*—Robert W. Jenkins
*Attorney, Agent, or Firm*—Katherine McGuire

[57] ABSTRACT

Apparatus for pumping, mixing and dispensing two liquids includes a conduit for tapping a remotely located container containing a first concentrated liquid such as methyl alcohol. A housing contains a second liquid for diluting the first liquid and a pump for pumping the two liquids at equal rates into a static mixing apparatus. The amount of first liquid entering the mixer may be decreased as desired via a needle valve located on a conduit leading back to the remotely located container. The mixer includes an internal cavity having a plurality of 90° hollow elbow joints randomly positioned therein such that the two liquids pass therethrough and combine into a resultant mixture. The mixture may be dispensed to a second remote location as desired.

10 Claims, 5 Drawing Sheets

LIQUID PUMPING, MIXING AND DISPENSING APPARATUS

BACKGROUND OF THE INVENTION

This invention relates to apparatus designed to pump fluids from separate sources, proportionally mix the fluids together, and dispense the resultant fluid to a specified location and, more particularly, to apparatus which is adapted to pump a concentrated liquid chemical from a remote location and pump it and water in predetermined proportions into a static mixing apparatus which includes means to dispense the resultant fluid to a remote location as desired.

In the automobile maintenance and repair industry, it is frequently necessary to dispense such liquids as antifreeze (an ethylene glycol solution) and windshield wash fluid (a methyl alcohol solution) into the automobile. Such liquids are typically available in either the one gallon container or fifty-five gallon drum size. The fifty-five gallon drum contains concentrated forms of the antifreeze and windshield wash fluid and is more economically attractive to large volume auto maintenance businesses than the one gallon container since it is both cheaper and easier to store. The product from the fifty-five gallon drum must be diluted with water to the appropriate concentration for use in an automobile. Present product/water mixing methods have included on-site manual mixing which not only tends to be inaccurate, but also allows product fumes to escape into the air, expose workers to the volatile product, and increase the occurance of accidental spills of the product which, of course, are all highly undesirable conditions. Another mixing method includes the use of a metallic reciprocating pump for pumping the product from the drum to a remote location where it may then be diluted with water. It has become evident that metallic reciprocating pumps are not compatible for use with liquids such as ethylene glycol and methyl alcohol and have resulted in frequent and costly pump repairs. Although plastic diaphragm pumps have been recently introduced in an attempt to overcome this problem, there still lacks effective apparatus which accurately and proportionally mixes concentrated product with water and dispenses the resultant liquid into a remotely located automobile while maintaining limited exposure of the worker to the concentrated product.

It is therefore a main object of the present invention to provide apparatus which proportionally mixes a liquid product in concentrated form with water in a closed system such that human exposure to the concentrated product is limited if not totally absent.

Another object of the invention is to provide apparatus which pumps concentrated product from conventional fifty-five gallon drums and mixes it with water to a predetermined and accurate concentration whereupon the diluted product may be dispensed at a remote location as desired.

Still another object of the invention is to provide such apparatus which includes components compatable for handling volatile products such as concentrated ethylene glycol and methyl alcohol, for example.

A further object of the present invention is to significantly limit the escape of noxious fumes of the concentrated product into the surrounding atmosphere.

Other objects will in part be obvious and in part appear hereinafter.

SUMMARY OF THE INVENTION

In accordance with the foregoing objects, the invention comprises a stainless steel housing having a bottom wall with four side walls extending vertically therefrom to define an open top having a removeable cover. The inside of the housing is adapted to contain a dual-inlet, duel-outlet, double-diaphragm pump which may be attached to an outside air source for operation. Water enters the housing through an inlet port on the bottom wall and fills the water-tight housing to a predetermined level which is maintained constant by the use of a conventional water intake valve and float. The water inside the housing is pumped into a first pump chamber while liquid product (e.g. concentrated methyl alcohol) in a remotely located separate container is pumped into the housing and directed into a second pump chamber. Operation of the pump causes equal amounts of water and product to travel through piping and into a static mixing apparatus also contained within the housing. The amount of product allowed into the mixer may be decreased via a needle valve located along a product return line which dispenses the excess product back into the product container. Once both the water and product have been proportioned and mixed inside the housing, the diluted product is then dispensed as desired via flexible hosing to a remote location such as an automobile radiator or windshield wash container, for example.

DETAILED DESCRIPTION

Figure 1:
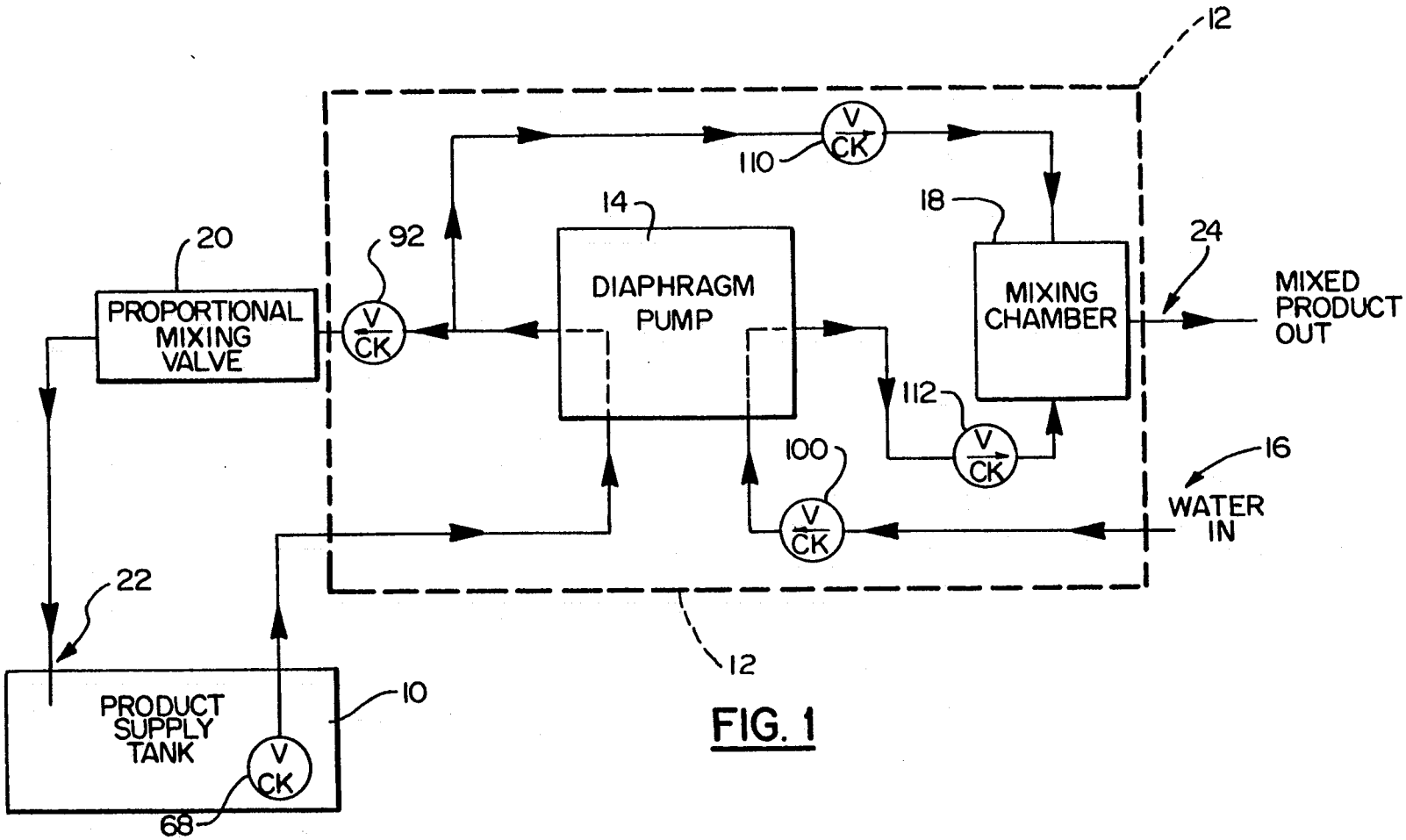
FIG. 1 is a block diagram illustrating the relational operation of the components of the invention.

Referring now to the drawings, there is seen in FIG. 1 a general block diagram of the invention showing a product supply tank 10 which is preferably a fifty-five gallon drum containing either concentrated automobile windshield wiper wash (methyl alcohol), or concentrated automobile anti-freeze (ethylene glycol). A housing 12 indicated by phantom lines contains a double-diaphragm pump 14 which pumps liquid product from tank 10 into a first pump chamber, and water from external supply 16 into a second pump chamber, pumping both liquids to mixing chamber 18. A proportional mixing valve 20 positioned externally of housing 12 is used to decrease the amount of product which may travel from pump 14 to mixer 18. As valve 20 is opened, excess product is allowed to travel back into tank 10 at point 22. The mixture of product and water exits chamber 18 and housing 12 at point 24 such that it may be dispensed at a remote location, as desired.

Having thus described the operation of the invention in overview fashion, the invention components may be seen with more particularity in FIGS. 2–6.

Figure 2:
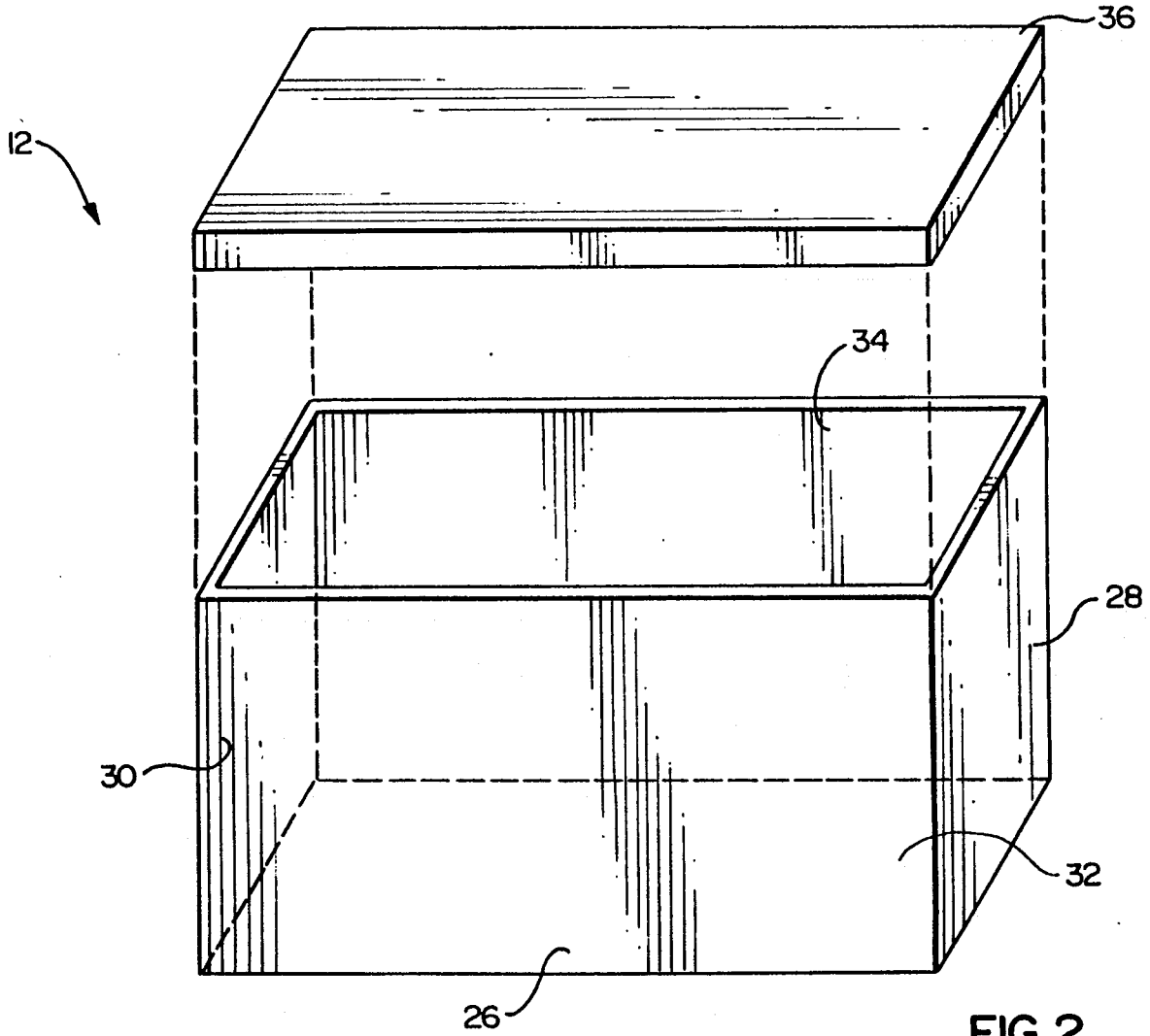
FIG. 2 is a perspective view of the housing with the housing cover in exploded relation thereto.
Figure 3:
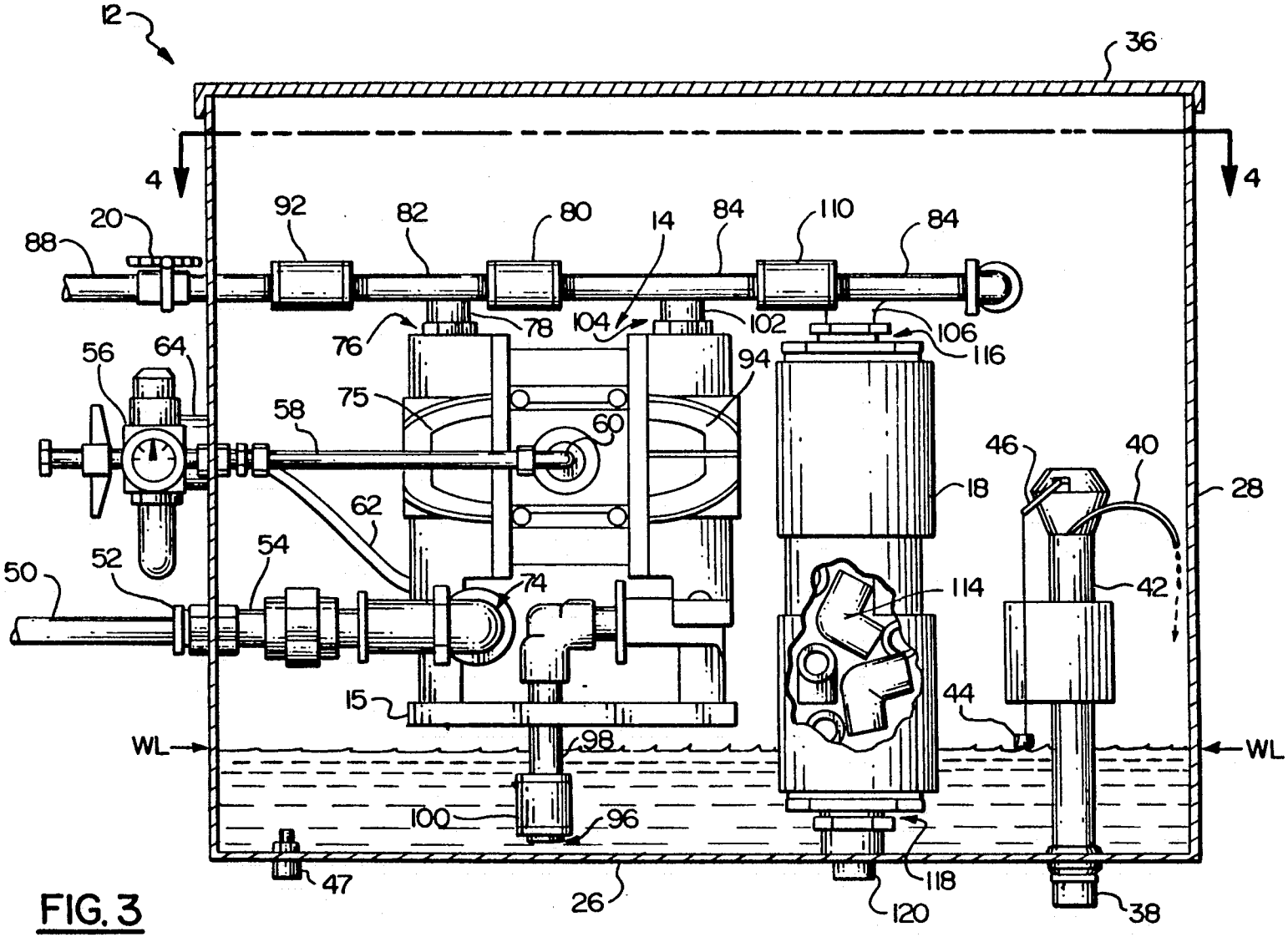
FIG. 3 is a side elevational view of the invention in cross section taken generally along the line 3—3 in FIG. 4 and showing the mixer partly broken away.

FIG. 2 shows housing 12 of generally rectilinear configuration having a bottom wall 26, opposite side walls 28 and 30, and respective, opposite side walls 32 and 34 which define an open top having removeable cover 36, housing 12 being preferably constructed of stainless steel. The internal components mounted within housing 12 may be seen in FIGS. 3 and 4. In particular, an external water source is hooked up to water inlet port 38 which communicates with the inside of housing 12 via water hose 40. Water is forcibly delivered into housing 12 at a maximum of 80 psi through hose 40 until a valve within conduit 42 (not shown) is closed upon the vertical lifting of float 44 and lever 46 caused by the rising water level within housing 12. The water within housing 12 is therefore maintained at a predetermined level by float 44 at the preferred level indicated by reference letters WL when lever 46 is in the fully lifted position as seen in FIG. 3. Water is thereby maintained within housing 12 so that it may be pumped by pump 14 into mixing chamber 18 and proportionally mixed with the product in the manner described below. Should overfilling of housing 12 occur, water may be easily drained through coupling 47 seen attached to bottom 26 of housing 12.

Figure 6B:
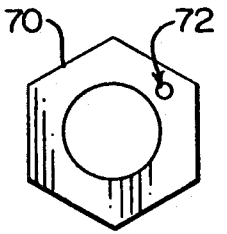
FIGS. 6*a* and 6*b* are cross-sectional, side elevational views of a portion of the invention attached to a fifty-five gallon drum container.
Figure 6A:
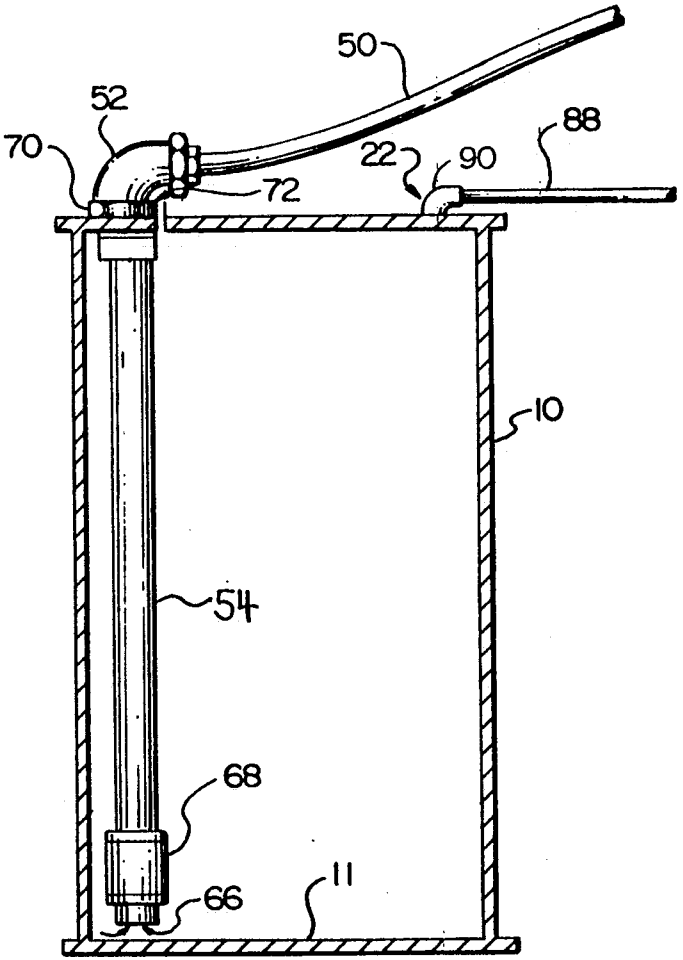

Referring to FIG. 6A, a product supply tank 10 for containing concentrated liquid products is tapped by tubing 50 and tap 52, tap 52 providing communication between tank conduit 54 and tubing 50. It is typical that concentrated liquid product containers be available in the fifty-five gallon drum size and be air-tight upon purchase. The invention herein described is best suited to be used for proportionally diluting concentrated liquids, especially methyl alcohol and ethylene glycol, with water, the concentrated liquid obtained from such fifty-five gallon drum containers as are typically purchased by large volume, automobile maintenance centers. It is therefore presumed that product supply tank 10 is of the fifty-five gallon capacity and contains either concentrated methyl alcohol or ethylene glycol for purposes of this description, it being understood that other concentrated liquid containers of various size and type, which contain various types of concentrated liquids requiring proportioned dilution with a second liquid, may be used with the invention herein described.

Figure 5:
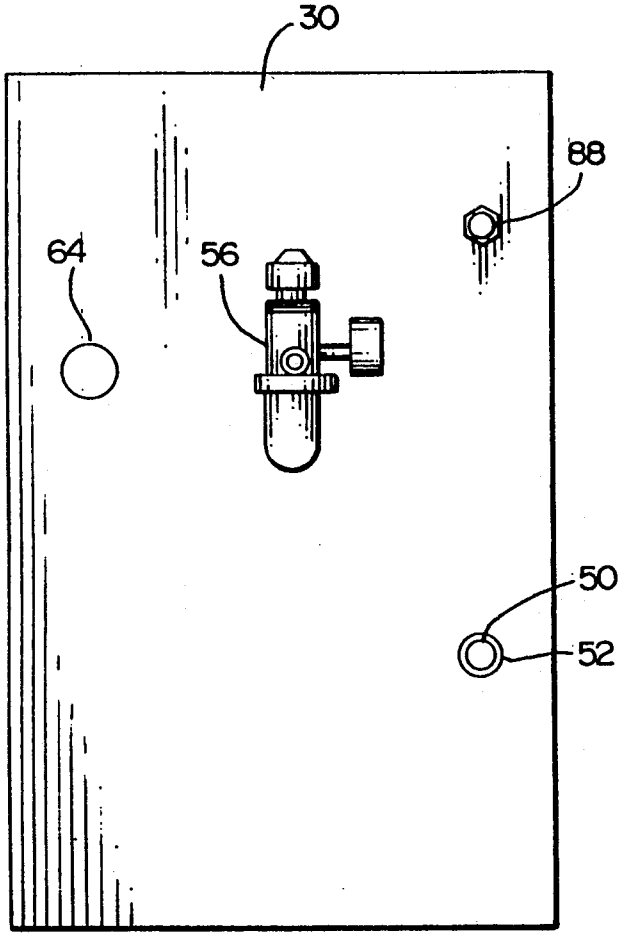
FIG. 5 is a side elevational view of the invention as seen along the line 5—5 of FIG. 4.

The opposite end of tubing 50 is attached to side wall 30 of housing 12 in the position seen in FIG. 5 via fitting 52. Appropriate piping 54 attaches tubing 50 to a first chamber 75 of pump 14 within housing 12 (FIG. 3). In this way, a product supply tank may be located remotely from housing 12 by a distance dictated only by the length of tubing 50.

Figure 4:
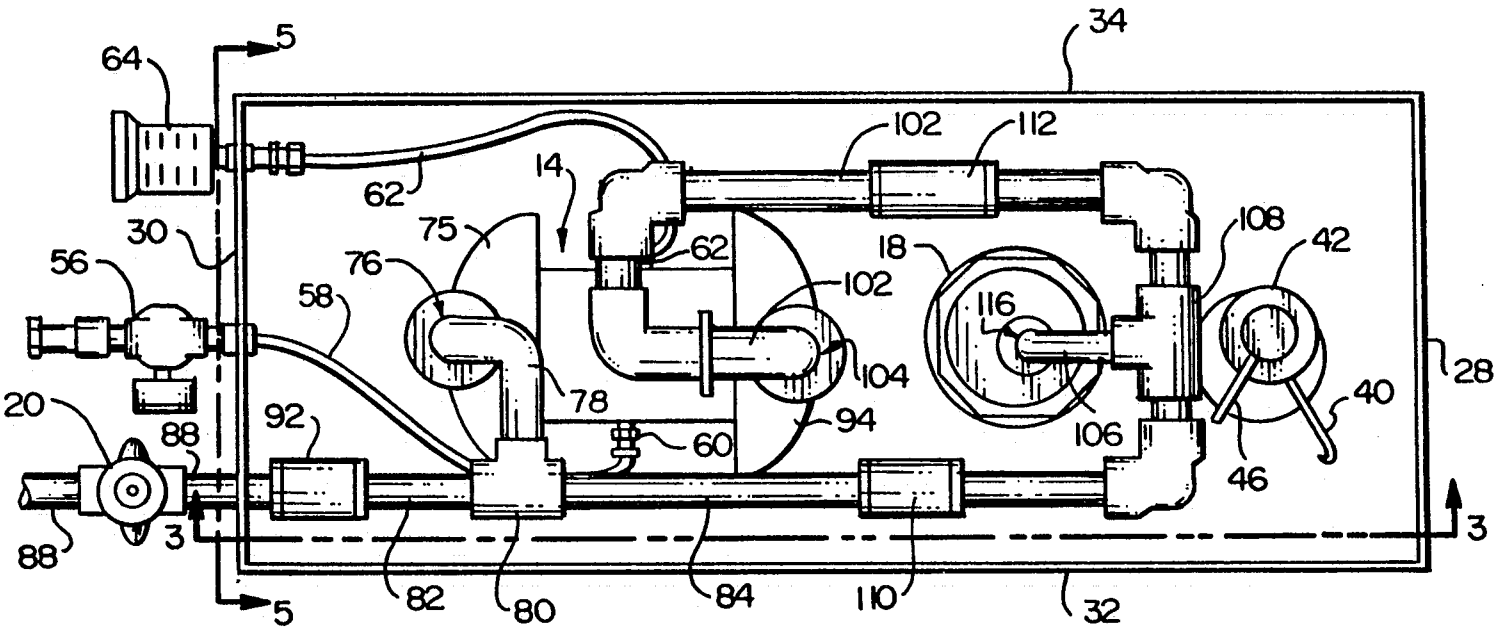
FIG. 4 is a top view of the invention as seen along the line 4—4 of FIG. 3.

Pump 14 is mounted within housing 12 as seen in FIG. 3 by mounting bracket 15 attached to side walls 32 and 34. Pump 14 is a double-diaphragm pump constructed of mainly PVC such that it may pump volatile liquids such as methyl alcohol and ethylene glycol without experiencing corrosion and the like as is typical of metal alloy pumps. The double-diaphragm pump 14 is designed with dual-inlets and dual-outlets, having two chambers for pumping equal amounts of two liquids therethrough. An example of such a double-diaphragm pump 14 may be seen in U.S. Pat. No. 4,789,131 and purchased through Graco Inc. of Minneapolis, Minn. Pump 14 is air actuated and has been determined to require air at approximately 50 psi for optimal working condition. An air compressor (not shown) is therefore provided and hooked up to air meter 56 attached to side wall 30. Air is supplied via air line 58 to the air inlet port 60 of pump 14. Air is exhausted from the opposite side of pump 14 via exhaust line 62 which connects to muffler 64 on the exterior of wall 30 (FIG. 4).

Discussing in more detail the method of operation of the invention, upon activation of pump 14 by air delivered at approximately 50 psi to pump air inlet port 60, pump 14 begins cycling by pumping product through tubing 50 from product tank 10 via the open end 66 of conduit 54 which is positioned adjacent but not touching the inside of bottom 11 of tank 10. Conduit 54 includes a spring-loaded check valve 68 so that product may not travel back through conduit 54 and into tank 10. Tap 52 is seen to include annular washer 70 including through hole 72 extending into the tank 10 which is provided to allow ambient air to enter tank 10 as product is pumped therefrom such that the inside of tank 10 is maintained at atmospheric pressure during operation of the system.

Product from tank 10 proceeds through tubing 50 and travels inside housing 12 through piping 54 to pump product inlet port 74. Product enters a first chamber 75 within pump 14 and is pumped out of pump 14 at product outlet port 76. Product travels through pipe 78 to three-way pipe joint 80 where it may enter both pipe 82 and pipe 84. The amount of product allowed to enter and pass through pipe 84 toward mixer 18 is controlled by proportioning or needle valve 20 which is positioned outside housing 12 adjacent wall 30. Valve 20 is attached to product return line 88 which taps tank 10 at inlet pipe 90 (FIG. 6A). When valve 20 is fully closed, product may not enter product return line 88 and all product pumped from pump 14 through pipe 78 is forced through pipe 84 to mixer 18. As valve 20 is opened, product is allowed to pass into return line 88 and return to tank 10 at 22. If valve 20 is fully opened, one hundred percent of the product from pump 14 will pass through return line 88 for reasons set forth below. Pipe 82 includes check valve 92 between joint 80 and side wall 30 such that product may not travel from pipe 82 back into pipe 78.

As pump 14 pumps product from product chamber 75 into pipe 78, the reciprocating stroke of the double-diaphragm pump 14 pumps water from housing 12 into second pump chamber 94 via open end 96 of pipe 98. Pipe 98 includes check valve 100 such that water is prevented from traveling from pipe 98 back into housing 12 through open end 96. When water from housing 12 fills chamber 94, pump 14 pumps the water from chamber 94 into pipe 102 via water outlet port 104. Since pump chambers 75 and 94 are of equal volumetric capacity, equal amounts of product and water are alternately pumped into pipes 78 and 102, respectively. As aforementioned, if valve 20 is in the fully closed position, all the product pumped from pump 14 through pipe 78 is directed through pipe 84. In this instance therefore, equal amounts of both water and product are directed toward and dispensed into mixer 18 via pipe 106, pipes 84 and 102 being connected to pipe 106 by three-way pipe joint 108 (FIG. 4). It is seen that pipes 84 and 102 include check valves 110 and 112, respectively, such that product and water pumped through pipes 84 and 102, respectively, cannot travel in the reverse direction back toward pump 14.

It should be apparent that as valve 20 is opened, product is allowed to travel through pipe 82 into product return line 88 and be deposited back into tank 10. The opening of valve 20 therefore decreases the amount of product which is directed through pipe 84 from pipe 78.

It may therefore be realized that unequal volumes of water and product may be dispensed into mixer 18 upon the manual opening of valve 20. Since valve 20 is a needle type valve, it may allow any fraction of the full volume of product pumped from pump 14 through pipe 78 to pass through into product return line 88. If valve 20 is in the fully open position, the water traveling through pipe 102 is allowed to travel through three-way pipe 108 and enter pipe 84 up to check valve 110. Since this pressure against check valve 110, all product travels through the least resistive path which is pipe 88. The possible ratios of water and product allowed to enter mixer 18 therefore fall anywhere between an even fifty-fifty product/water mix (when valve 20 is fully closed), to a one hundred percent water to zero percent product mix (when valve 20 is fully opened). If the product being diluted with the present invention is concentrated methyl alcohol (windshield wash fluid), or ethylene glycol (antifreeze), then it is desirous to obtain different product/water mixes at different times of the year in a variable climate, geographic location. For example, in the winter months (e.g. January and February) in the northern parts of the United States where ambient temperatures typically drop to below freezing level (i.e., less than 0° C.), the antifreeze used in automobile radiators requires to be diluted with less water than in the summer months to prevent freezing of the antifreeze/-water mix in the radiator. In the summer months, more water may be mixed with the antifreeze since there is less concern of freezing. Therefore, in the winter months, an antifreeze/water mix should be approximately fifty-fifty which may be achieved with the invention herein when valve 20 is fully closed. As the ambient temperatures increase with the onset of spring and summer, valve 20 should be opened partially to attain a predetermined product/water mix ratio which should lie somewhere around a ninety percent water to ten percent product ratio. The same is true if the product used is windshield wash fluid which is why this invention is especially suited for use in the automobile maintenance industry for diluting and dispensing antifreeze and windshield wash fluid into automobiles.

Returning discussion now back to the drawings, it is seen in FIG. 3 that mixer 18 is vertically mounted within housing 12 and has an internal cavity including a plurality of 90° elbow pipe joints 114 randomly positioned therein. As water and product enter pipe 106 from pipes 102 and 84, respectively, they are dispensed into the top of mixer 18 at mixer inlet port 116. The water and product travel to the bottom of mixer 18, passing through a number of the joints 114 along the way. The water and product are thereby mixed together and exit mixer 18 through mixer outlet port 118 and exit housing 12 at attached pipe 120. Pipe 120 includes means for the releasable attachment of a dispensing hose (not shown) which includes an appropriate nozzle at its opposite end such that a worker may selectively dispense the water/product mix through the nozzle into a remotely located automobile, for example.

To recapitulate briefly, product and water are pumped through pipes 102 and 84 by double-diaphragm pump 14 into mixer 18. It is noted that the water contained in housing 12 is maintained at level WL by virtue of water float 44 and valve 42 as it is pumped into pump 14. The resulting water/product ratio is controlled by needle valve 86 whereby the amount of product allowed to pass through pipe 84 to be mixed with water from pipe 102 may be decreased by opening valve 20 to allow product to pass through product return line 88 and be dispensed back into tank 10. Mixer 18 statically mixes product and water received from pipe 106 and dispenses the resultant liquid through pipe 120 to an attached dispensing hose (not shown).

There is thus provided a novel and unique system for pumping and mixing a product from a remotely located tank with a second liquid such as water, and dispensing the mixture to a remote location. No human contact with the product occurs until it is in its diluted form ready for dispensing. Concentrated forms of a liquid product in bulk containers may be used without the need of manual mixing of the product with water which can prove to be both hazardous and inaccurate.

What is claimed is:

1. Apparatus for pumping a first liquid from a first remote location and mixing said first liquid in predetermined proportion with a second liquid, said apparatus including means to dispense the mixture of said first and second liquid to a second remote location, said apparatus comprising:

(a) a housing having an internal cavity adapted to receive and contain said second liquid;

(b) a first conduit having first and second ends, said first end communicating with said first liquid at said first remote location;

(c) a pump mounted in said housing internal cavity, said pump having first and second inlet ports and first and second outlet ports, said first conduit second end communicating with said first inlet port and said second liquid contained in said housing communicating with said second inlet port, said pump being operable to discharge said first and second liquids through said first and second outlet ports, respectively, at substantially equal rates;

(d) second and third conduits each having first and second ends, said second conduit first end communicating with said first outlet port and said third conduit first end communicating with said second outlet port;

(e) static mixing means having a third inlet port and a third outlet port, said second ends of both of said second and third conduits communicating with said third inlet port, whereby said first and second liquids are dispensed into said static mixing means and combined therein into said mixture; and (f) a fourth conduit having first and second ends, said fourth conduit first end communicating with said third outlet port and said fourth conduit second end communicating with said second remote location.

2. The invention according to claim 1 and further including a fifth conduit having first and second ends, said fifth conduit first end communicating with said first liquid at said first remote location, said fifth conduit second end communicating with said second conduit, said fifth conduit including a first valve incorporated therein wherein manual manipulation of said valve causes a predetermined portion of said first liquid traveling through said second conduit to be directed through said fifth conduit and be dispensed from said fifth conduit first end.

3. The invention according to claim 2 wherein said valve is located externally of said housing.

4. The invention according to claim 2 wherein said valve is a needle type valve.

5. The invention according to claim 1 wherein said pump is a double diaphragm pump.

6. The invention according to claim 1 and further including a fourth inlet port on said housing and a second valve and float assembly mounted within said housing and communicating with said fourth inlet port wherein said second liquid is dispensed within said housing through said fourth inlet port and said assembly, said float manually adjustable to cause said second valve to move between open and closed positions upon a predetermined amount of said second liquid dispensed into said housing whereby amounts of said second liquid dispensed within said housing which are less than said predetermined amount of said second liquid cause said assembly valve to assume said open position whereupon said second liquid travels through said fourth inlet port and dispenses into said housing, and whereupon amounts of said second liquid in said housing equal to or greater than said predetermined amount cause said assembly valve to assume said closed position whereupon said second liquid is prevented from dispensing into said housing.

7. The invention according to claim 1 wherein said static mixing means comprises a mixing housing having an internal cavity, said internal cavity containing a plurality of hollow elbow joints each having a substantially 90° through-hole, said joints being randomly arranged in said internal cavity such that said first and second liquid travel through said elbow joint through-holes.

8. The invention according to claim 1 wherein said housing has a bottom with side walls extending therefrom to define an open top, said top including a releasably attached cover.

9. The invention according to claim 8 and further including a fifth outlet port attached to said housing including means to drain said second liquid from said housing.

10. The invention according to claim 1 wherein said static mixing means is mounted in said housing internal cavity.

* * * * *